United States Patent [19]

Penny et al.

[11] 4,098,150

[45] Jul. 4, 1978

[54] CONE LOCKING SYSTEM FOR A ROTARY ROCK BIT

[75] Inventors: Samuel Lee Penny, Lancaster; Robert Dale Clamon, Mesquite, both of Tex.

[73] Assignee: Dresser Industries, Inc., Dallas, Tex.

[21] Appl. No.: 761,739

[22] Filed: Jan. 24, 1977

[51] Int. Cl.[2] ..... B21K 5/02

[52] U.S. Cl. ..... 76/108 A

[58] Field of Search ..... 76/108 A, 108 R; 308/8.2; 175/227, 228, 301, 354, 367, 319

[56] References Cited

U.S. PATENT DOCUMENTS

| | | | |
|---|---|---|---|
| 1,909,078 | 5/1933 | Scott | 175/228 |
| 1,909,128 | 5/1933 | Scott et al. | 175/228 |
| 2,076,002 | 4/1937 | Reed | 308/8.2 |
| 3,746,405 | 7/1973 | Welton | 308/8.2 |
| 4,043,411 | 8/1977 | Lichte | 76/108 A |

*Primary Examiner*—Harold D. Whitehead
*Assistant Examiner*—Roscoe V. Parker
*Attorney, Agent, or Firm*—Eddie E. Scott

[57] ABSTRACT

The rolling cone cutter of a rotary rock bit is held in place on the bearing pin without the use of the conventional ball bearings. The bit includes a body with a bearing pin extending from the body. A rolling cutter is adapted to be rotatably mounted on the bearing pin. A locking means locks the cutter on the bearing pin. The locking means includes a groove in either the roller cutter or the bearing pin. A flange-type retaining element positioned on the opposite member, either the rolling cutter or bearing pin, projects into the groove and retains the rolling cutter on the bearing pin.

3 Claims, 4 Drawing Figures

CONE LOCKING SYSTEM FOR A ROTARY ROCK BIT

BACKGROUND OF THE INVENTION

The present invention relates to the art of earth boring and, more particularly, to a rotary rock bit with improved means for retaining the cutter on the bearing pin. The present invention is especially adapted for use in that type of rotary rock bit popularly known as a rotary cone bit; however, its use is not restricted thereto, and the present invention can be used in other types of rolling cutter rock bits.

A rotary cone rock bit is adapted to be connected as the lowest member of a rotary drill string. As the drill string is rotated, the bit disintegrates the earth formations to form an earth borehole. The bit includes individual arms that extend angularly downward from the main body of the bit. The lower end of each arm is shaped to form a spindle or bearing pin. A cone cutter is mounted upon each bearing pin and adapted to rotate thereon. Individual bearing systems promote rotation of the cone cutters. The bearing systems have traditionally been roller bearings, ball bearings, friction bearings, or a combination of the aforementioned bearings. The cone cutters include cutting structure on their outer surfaces that serve to disintegrate the formations as the bit is rotated.

The rotary rock bit must operate under very severe conditions, and the size and geometry of the bit is restricted by the operating characteristics. Some means for locking the cone cutter on the bearing pin must be provided. Traditionally, the locking function has been performed by a ball bearing system. Other systems are known, for example, a roller bearing locking system. Such systems have not been entirely satisfactory.

DESCRIPTION OF PRIOR ART

In U.S. Pat. No. 3,361,494 to E. M. Galle, patented Jan. 2, 1968, a journal bearing bit is shown. The rolling cutter is secured on the bearing pin without the use of a ball bearing system. A bearing pin or shaft is provided in the form of a complete figure of revolution and including a laterally projecting portion or lip of greater diameter than the portion of the shaft axial therebehind, and a cutter with an internal contour exactly matching the shaft surface except for the small increments in diameter for lubricant volume, manufacturing, and the like. This bearing pin is then relieved, to the extent necessary for mounting the cutter, by machining downwardly from that portion of its surface opposite the pressure side of the shaft, i.e., the "non-pressure" side. The pressure side of the shaft is that part nearest the bottom and side wall of the formation borehole, as indicated by the vertical plane through the axis of the bearing pin, and the non-pressure side is its diametrically opposed counterpart. The pressure side of any shaft is the portion designed or adapted for maximum load transmission. The rolling cutter is then assembled to the bearing pin by combination of linear, sliding and cocking movements, or in some cases a succession of linear or sliding movement. A portion of the cutter is thus positioned behind the aforementioned lip or flange of the bearing pin, and it is this lip which prevents the cutter from being withdrawn by axial movement only. Withdrawal can be accomplished only by reversing the assembly procedure including any cocking movement.

Such disassembly is prevented by inserting a plug into a bore extending from the outside of the bit leg completely through the bearing pin, or at least by a plug member secured in a bore or the recess in the bearing pin and having an end projecting outwardly into a space between the bearing pin and the cutter. This plug projects from the bearing pin into a gap or recess in a part of the inside surface of the cutter which would have to be cocked or otherwise moved in disassembly in such a manner as to make such cocking or other movement impossible, thereby locking the two members together. The plug is secured in this position by any conventional means, e.g., welding it to the bit head at the entrance of the bore.

In U.S. Pat. No. 3,746,405 to Russell L. Welton, patented July 17, 1973, a well drilling bit is shown. A journal bearing of right cylinder form is provided, characterized by the formation of a strategically placed recess, or recesses therein and all without subtracting from the load carrying capabilities of the bit. The assembly is retained in working condition by a single element combined with the lubrication means and assuring proper axial placement of the roller cutter.

In U.S. Pat. No. 1,909,078 to F. L. Scott, patented May 16, 1933, an internally threaded journal bushing is secured inside the cutter by a locking ring and mounted on the bearing pin by an engagement of the bushing threads to corresponding threads on the surface of the bearing pin. While such arrangements worked satisfactorily, they involved at least two parts (bushing and locking ring) in addition to the bearing pin and cutter, plus considerable machining to form the threads, groove for locking ring, etc. In addition, the bushing interposed between bearing pin and cutter and not integral with either, subtracted from the bearing pin diameter, cutter shell thickness, or both. Although threadedly secured to the bearing pin, thus not rotating with the cone, it could not be considered a part of the bearing pin and was an independent source of trouble as well as reducing the strength of the bearing pin.

In U.S. Pat. Nos. 1,852,478; 1,867,531; 1,921,700 and 1,921,701 to E. A. Reed, earth boring bits are shown including a bearing pin, a bushing in at least one part, a cutter, and a locking pin. A lug and recess structure located on the bearing pin and bushing at right angles to the locking pin prevented the bushing from rotating. The main surfaces of the bearing pin, the bushing and the cutter were completely conical surfaces having an included angle of 90°, this feature plus the locking pin and lug and recess features purportedly making it possible to assemble apart without the use of threads but being unworkable for any included angle less than 90°.

In U.S. Pat. No. 1,854,624 to A. F. Powell, patented Apr. 19, 1932, a well drilling bit is shown. A bearing pin is utilized in the form of a complete right cylinder. A bushing is threaded onto the bearing pin. The cutter is secured to the bushing by an annular locking ring extending radially between the two members about midway between the ends of the bushing.

In U.S. Pat. No. 2,620,686 to R. G. Peter, patented Dec. 9, 1952, a method of mounting cutter upon an earth boring bit is shown. A lip was formed by heating the bearing pin and while it was hot and plastic forcing the cutter on it by an axial compressive movement, thus upsetting the plastic metal into the groove of the cutter.

In U.S. Pat. No. 2,076,002 to C. E. Reed, patented Apr. 6, 1937, an anti-friction bearing assembly for earth boring drills is shown. The cutter is retained by a spindle that is attached to the bit body by welding.

SUMMARY OF THE INVENTION

The present invention provides an improved rotary rock bit and method of constructing a rock bit that will allow the journal bearing and/or the cutter bearing to be made separately from the arm and/or cutter and manufactured to a much greater degree of precision than is now practical. The cutter is held in place on the journal by a locking means instead of the prior art ball bearing. The locking means includes a groove in either the rolling cutter or the journal. A flange-type retainer element positioned on the opposite member, either the rolling cutter or journal, projects into the groove and retains the rolling cutter on the journal. The above and other features and advantages of the present invention will become apparent upon consideration of the following detailed description of the invention when taken in conjunction with the accompanying drawings.

DETAILED DESCRIPTION OF THE INVENTION

Figure 1:
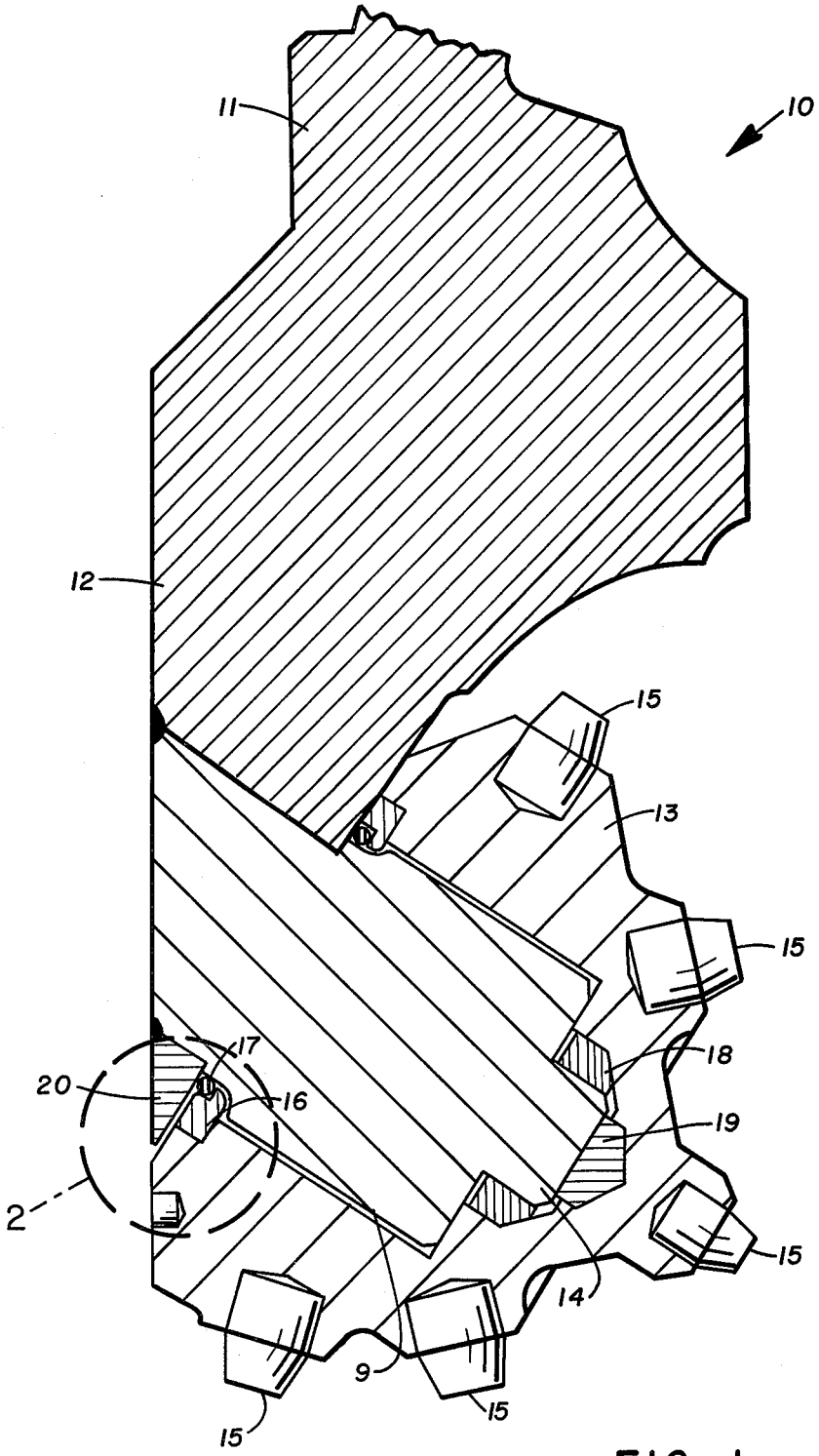
FIG. 1 is an illustration of a rotary rock bit constructed in accordance with the present invention.

Referring now to FIG. 1, a sectional view of one arm 12 of one embodiment of a rotary rock bit 10 incorporating the present invention is shown. It is to be understood that the structure of the other arms are substantially identical to the arm 12. The body 11 of bit 10 includes a threaded portion that allows the bit 10 to be connected to the lower end of a rotary drill string (not shown). The bit 10 also includes a central passageway extending along the central axis of the bit to allow drilling fluid to enter from the upper section of the drill string (not shown) immediately above and pass downward to the bottom of the well bore to flush cuttings and drilling debris from the well bore.

A cutter 13 is rotatably positioned on the journal portion or bearing pin 14 extending from the arm 12. The cutter 13 is adapted to disintegrate the earth formations as the bit 10 is rotated. The cutting structure 15 on the surface of cutter 13 contacts and disintegrates the formations in a manner that is well known in the art. The cutting structure 15 is shown in the form of tungsten carbide inserts. However, it is to be understood that other cutting structures such as steel teeth may be used as the cutting structure on the cone cutter 13. The cutter 13 is locked on the bearing pin 14 by a flange-type retainer ring 16 that extends into a groove in bearing pin 14. The retainer ring 16 is welded to the cutter 13 by an electron beam weld. This may be accomplished using a beam of electrons produced by an electron beam gun. The beam is caused to move in the plane of the seam between the cutter 13 and retainer ring 16. The beam has a high intensity (10 KW/mm$^2$) and a higher power capacity (60 KW). The electron beam penetrates substantially through the area to be joined. The electron beam does not add material to produce a build-up of deposit along the seam and there is little, if any, warpage.

Figure 2:
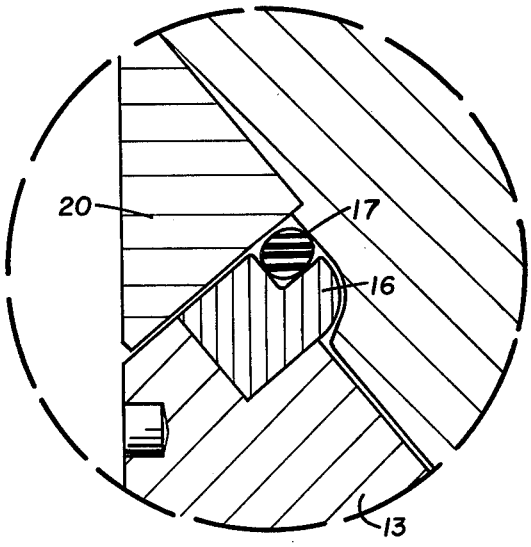
FIG. 2 is an enlarged view of a portion of the bit shown in FIG. 1.

The bearing pin 14 is constructed and processed separately from the arm 11 and subsequently welded to the arm 12. The bearing pin 14 can be machined separate and apart from the rock bit arm 11 and the carburizing process is simplified because the bearing pin 14 can be treated separately. A passage extends through the arm 12. The passage extends from the shirttail 20 through the arm 12 to the cutter receiving surface. The bearing pin 14 includes an annular mounting surface that forms the mounting section of the bearing pin 14. This annular mounting surface is located in the passage in the arm 12. The bearing pin 14 includes an extended bearing surface 9 as well as other bearing surfaces which provide the bearing surfaces that support the cutter 13. As best shown in FIG. 2, a seal 17 is positioned to block flow through the space between the cutter 13 and the bearing pin 14. This seal 17 retains lubricant in the bearing area between the cutter 13 and bearing pin 14 and prevents any materials in the well bore from entering the bearing area.

The annular mounting surface of the passage extending through arm 12 and the annular mounting surface of the bearing pin 14 form a seam. The bearing pin 14 is welded to the arm 12 by directing a beam of high-velocity electrons into the seam to fuse the bearing pin 14 to the arm 12. The beam of electrons is produced by an electron beam gun and the beam is caused to move in the plane of the beam by relative movement between the beam and the seam. The beam has a high intensity (10 KW/mm$^2$) and a high-power capacity (60 KW). The welding operation is conventionally carried out in a vacuum chamber; however, it is to be understood that a laser beam could also be used and that a vacuum chamber might not be necessary. The electron beam penetrates substantially through the area to be joined. The energy from the electron beam is applied rapidly thereby preventing heat build-up and reducing the danger of damaging the portions of the rock bit that have a low tolerance to heat such as the seal 17 and the lubricant. The electron beam does not add material to produce a build-up of deposit along the seam and there is very little, if any, warpage.

The structural elements of one embodiment of a rotary rock bit constructed in accordance with the present invention having been illustrated, the method of constructing a rock bit according to the present invention will now be considered with reference to FIGS. 1 and 2. Some means must be provided for locking the cone cutter 13 on the bearing pin 14. Traditionally, the locking function has been performed by a ball bearing system. The present invention locks the cone cutter 13 on the bearing pin 14 without the use of the conventional ball bearing system. A substantial uninterrupted bearing area 9 is provided between the bearing pin 14 and the rotatable cutter 13. The bearing pin 14 is constructed and processed separately from the arm 12. The bearing pin 14 can be machined separate and apart from the arm 12 and the carburizing process is simplified because the bearing pin can be treated separately from the arm 12.

The cone cutter 13 is mounted over the bearing pin 14. The bearing area may be prelubricated prior to assembly or lubricated after assembly and a lubrication system may be provided in a manner well known in the art. The annular flange 16 is mounted in position in an annular receiving groove in the mouth of the cone cutter 13. The inner portion of the flange 16 projects into the annular recess in the bearing pin 14. A seam is formed between the annular receiving groove in the mouth of the cone cutter and the outside surface of the annular flange 16. The flange 16 is welded to the cone cutter 13 by directing a beam of high-velocity electrons into the seam between the flange 16 and the cutter 13. The beam of electrons is produced by an electron beam gun and the beam is caused to move in the plane of the seam by relative movement between the beam and the seam. The beam has a high intensity (10 KW/mm$^2$) and a high-power capacity (60 KW). The welding operation is conventionally carried out in a vacuum chamber; however, it is to be understood that a laser beam could also be used and that a vacuum chamber might not be necessary. The electron beam penetrates substantially through the area to be joined. The energy from the electron beam is applied rapidly thereby preventing heat build-up. The electron beam does not add material to produce a build-up of deposit along the seam and there is very little, if any, warpage. With the flange 16 welded to the cutter 13, the cutter 13 is rotatably locked upon the bearing pin 14.

The bearing pin 14 with the cone cutter 13 rotatably locked thereon is now ready for assembly on the arm 11. A passage is machined into the arm 12. The passage extends from the shirttail 20 through the arm 12 to the cutter receiving surface. The annular seal 17 is positioned around the bearing pin 14 and seated in the seal recess in the annular flange 16. The mounting portion of the bearing pin 14 is positioned in the passage in the arm 12. The annular mounting surface of the mounting section of the bearing pin 14 and the annular mounting surface of the passage in the arm 12 form a seam. The bearing pin 14 is welded to the arm 12 by fusing the annular mounting surface of the mounting section of bearing pin 14 to the annular mounting surface of the passage through an arm 12. This is accomplished by directing a beam of high-velocity electrons into the seam to fuse the bearing pin 14 to the arm 11. The beam of electrons is produced by an electron beam gun and the beam is caused to move in the plane of the seam by relative movement between the beam and the seam. The beam has a high intensity (10 KW/mm$^2$) and a high-power capacity (60 KW). The welding operation is conventionally carried out in a vacuum chamber; however, it is to be understood that a laser beam could also be used and that a vacuum chamber might not be necessary. The electron beam penetrates substantially through the area to be joined. The energy from the electron beam is applied rapidly thereby preventing heat build-up and reducing the danger of damaging the portions of the rock bit that have a low tolerance to heat such as the seal 17 and the lubricant. The electron beam does not add material to produce a build-up of deposit along the seam and there is very little, if any, warpage.

Figure 3:
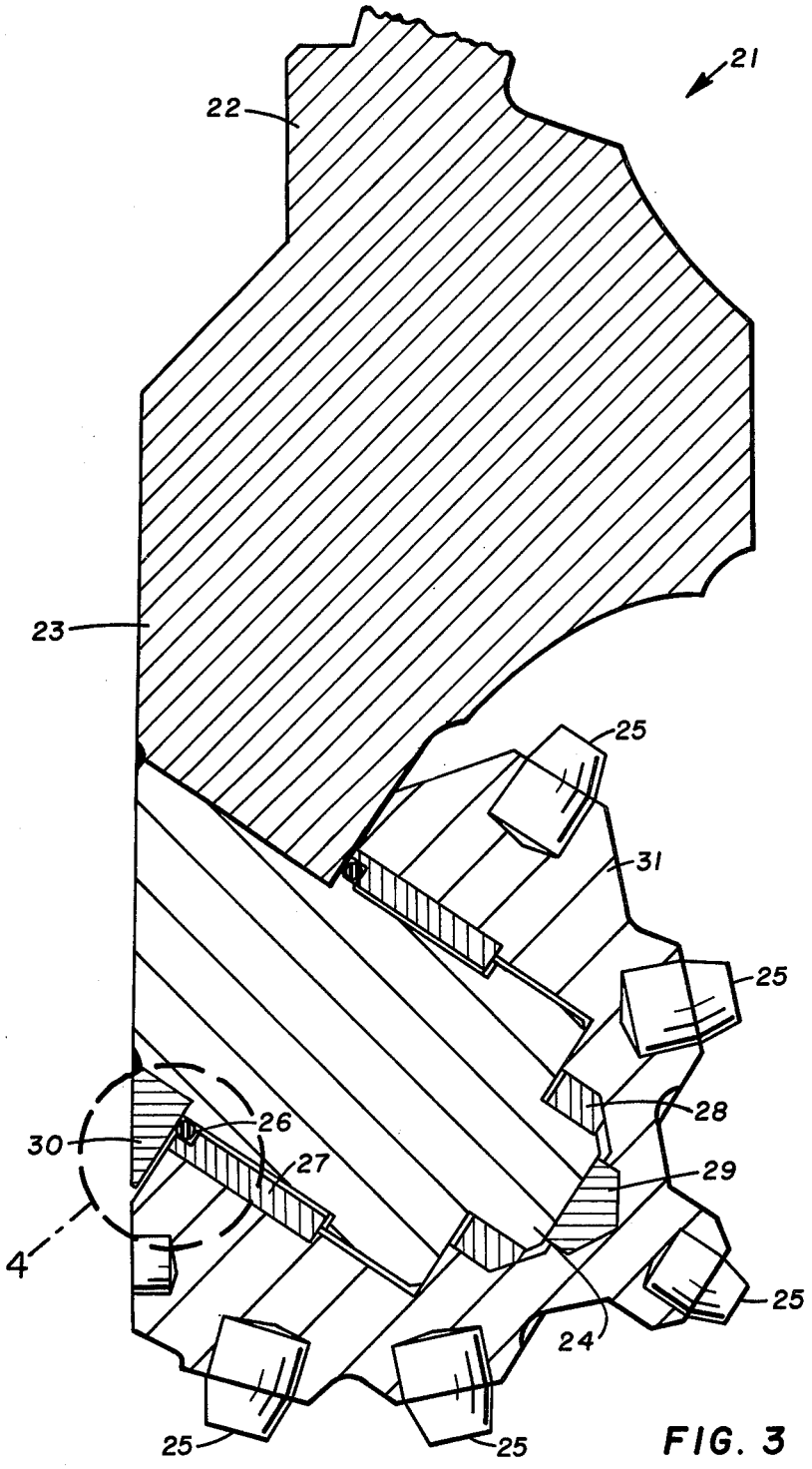
FIG. 3 is an illustration of another embodiment of a rotary rock bit constructed in accordance with the present invention.

Referring now to FIG. 3, a sectional view of one arm 23 of another embodiment of a rotary rock bit 21 illustrating the present invention is shown. It is to be understood that the structure of the other arms are substantially identical to the arm 23. The body 22 of bit 21 includes a threaded portion that allows the bit 21 to be connected to the lower end of a rotary drill string (not shown). The bit 21 also includes a central passageway extending along the central axis of the bit to allow drilling fluid to enter from the upper section of the drill string (not shown) immediately above and pass downward to the bottom of the well bore to flush cuttings and drilling debris from the well bore.

A cutter 31 is rotatably positioned on the journal or bearing pin 24 extending from the arm 23. The cutter 31 is adapted to disintegrate the earth formations as the bit 21 is rotated. The cutting structure 25 on the surface of cutter 31 contacts and disintegrates the formations in a manner that is well known in the art. The cutting structure 25 is shown in the form of tungsten carbide inserts. However, it is to be understood that other cutting structures such as steel teeth may be used as the cutting structure on the cone cutter 31. The cutter 31 is locked on the bearing pin 24 by an annular retainer and bearing element 27. The retainer and bearing element 27 is fused to the cutter 31 by an electron beam weld. The retainer and bearing element projects into a groove in the bearing pin 24 to rotatably lock the cutter 31 on the bearing pin 24.

Figure 4:
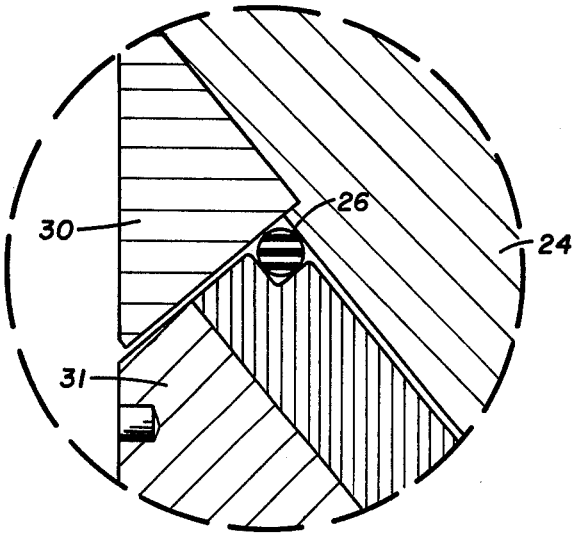
FIG. 4 is an enlarged view of a portion of the bit shown in FIG. 3.

The bearing pin 24 is constructed and processed separately from the arm 23 and subsequently welded to the arm 23. The bearing pin 24 can be machined separate and apart from the rock bit arm 23 and the carburizing process is simplified because the bearing pin 24 can be treated separately from the rock bit arm 23. A passage extends through the arm 23. The passage extends from the shirttail 30 through the arm 23 to the cutter receiving surface. The bearing pin 24 includes an annular mounting surface that forms the mounting section of the bearing pin 24. This annular mounting surface is located in the passage in the arm 23. The annular mounting surface of the passage in the arm 23 and the annular mounting surface of the bearing pin 24 form a seam. The bearing pin 24 is welded to the arm 23 by directing a beam of high-velocity electrons into the seam to fuse the bearing pin 14 to the arm 12. The bearing pin 24 includes an extended bearing section which provides the bearing surfaces that support the cutter 31. As best shown in FIG. 4, a seal 26 is positioned to block flow through the space between the cutter 31 and the bearing pin 24. This seal 26 retains lubricant in the bearing area between the cutter 31 and bearing pin 24 and prevents any materials in the well bore from entering the bearing area.

The structural elements of a second embodiment of a rotary rock bit constructed in accordance with the present invention having been illustrated, the method of constructing a rock bit according to the present invention will now be considered with reference to FIGS. 3 and 4. Some means must be provided for locking the cone cutter 31 on the bearing pin 24. Traditionally, the locking function has been performed by a ball bearing system. The present invention locks the cone cutter 31 on the bearing pin 24 without the use of the conventional ball bearing system. A substantial bearing area is provided between the bearing pin 24 and the rotatable cutter 31. The bearing pin 24 is constructed and processed separately from the arm 23. The bearing pin 24 can be machined separate and apart from the arm 23 and the carburizing process is simplified because the bearing pin can be treated separately from the arm 24. In addition, the retainer and bearing element 27 may be processed separately from the other elements of the bit 21.

The cone cutter 31 is mounted over the bearing pin 24. The bearing area may be prelubricated prior to assembly or lubricated after assembly and a lubrication system may be provided in a manner well known in the art. The retainer and bearing element 27 is mounted in position in an annular receiving groove extending from the mouth of the cone cutter 31. The retainer and bearing element 27 projects into the annular recess in the bearing pin 24. A seam is formed between the cone cutter and the outside surface of the annular retainer and bearing element 27. The retainer and bearing element 27 is welded to the cone cutter 31 by directing a beam of high-velocity electrons into the seam. The beam of electrons is produced by an electron beam gun and the beam is caused to move in the plane of the seam by relative movement between the beam and the seam. The beam has a high intensity (10 $KW/mm^2$) and a high-power capacity (60 KW). The welding operation is conventionally carried out in a vacuum chamber; however, it is to be understood that a laser beam could also be used and that a vacuum chamber might not be necessary. The electron beam penetrates substantially through the area to be joined. The energy from the electron beam is applied rapidly thereby preventing heat build-up. The electron beam does not add material to produce a build-up of deposit along the seam and there is very little, if any, warpage. With the retainer and bearing element 27 welded to the cutter 31 the cone cutter 31 is rotatably locked upon the bearing pin 14.

The bearing pin 24 with the cone cutter 31 rotatably locked thereon is now ready for assembly on the arm 23. A passage is machined into the arm 23. The passage extends from the shirttail 30 through the arm 23 to the cutter receiving surface. The annular seal 26 is positioned around the bearing pin 24 and seated in the seal recess in the annular retainer and bearing element 27. The mounting portion of the bearing pin 24 is positioned in the passage in the arm 23. The annular mounting surface of the mounting section of the bearing pin 24 and the annular mounting surface of the passage in the arm 23 form a seam. The bearing pin 24 is welded to the arm 23 by fusing the annular mounting surface of the mounting section of bearing pin 24 to the annular mounting surface of the passage through arm 23. This is accomplished by directing a beam of high-velocity electrons into the seam to fuse the bearing pin 24 to the arm 23. The beam of electrons is produced by an electron beam gun and the beam is caused to move in the plane of the seam by relative movement between the beam and the seam. The beam has a high intensity (10 $KW/mm^2$) and a high-power capacity (60 KW). The welding operation is conventionally carried out in a vacuum chamber; however, it is to be understood that a laser beam could also be used and that a vacuum chamber might not be necessary. The electron beam penetrates substantially through the area to be joined. The energy from the electron beam is applied rapidly thereby preventing heat build-up and reducing the danger of damaging the portions of the rock bit that have a low tolerance to heat such as the seal 26 and the lubricant. The electron beam does not add material to produce a build-up of deposit along the seam and there is very little, if any, warpage.

The embodiments of an invention in which an exclusive property or privilege is claimed are defined as follows:

1. A method of constructing a rotary rock bit, comprising the steps of:

providing a rock bit arm;

providing a bearing pin, said bearing pin having a bearing section with an annular bearing surface and a mounting section with a bearing pin mounting surface;

providing a rotatable cutter having an annular bearing surface adapted to functionally interact with said annular bearing surface of said bearing section of said bearing pin;

providing an annular retainer element and an annular groove for receiving said annular retainer element, said retainer element and groove cooperating to lock said cutter on said bearing pin;

providing a mounting recess in said rock bit arm, said mounting recess having a recess mounting surface;

positioning said mounting section of said bearing pin in said mounting recess of said rock bit arm thereby forming a seam between said bearing pin mounting surface and said recess mounting surface;

directing a beam of energy into said seam; and causing relative movement between said beam of energy and said seam to fuse said mounting surface of said bearing pin to said mounting surface of said mounting passage.

2. A method of constructing a rotary rock bit, comprising the steps of:

providing a rock bit arm;

providing a bearing pin, said bearing pin having a bearing section with an annular bearing surface and a mounting section with a bearing pin mounting surface;

providing a rotatable cutter having an annular bearing surface adapted to functionally interact with said annular bearing surface of said bearing section of said bearing pin;

providing an annular groove on said bearing pin;

providing an annular retainer element;

positioning said annular retainer element around said bearing pin projecting into said annular groove with said rotatable cutter being positioned over said bearing pin adjacent said annular retainer element thereby forming a first seam between said annular retainer element and said rotatable cutter;

directing a beam of energy into said first seam;

causing relative movement between said beam of energy and said first seam to fuse said annular retainer element to said rotatable cutter, said retainer element and groove cooperating to lock said cutter on said bearing pin;

providing a mounting recess in said rock bit arm, said mounting recess having a recess mounting surface;

positioning said mounting section of said bearing pin in said mounting recess of said rock bit arm thereby forming a second seam between said bearing pin mounting surface and said recess mounting surface;

directing a beam of energy into said second seam; and causing relative movement between said beam of energy and said seam to fuse said mounting surface of said bearing pin to said mounting surface of said mounting passage.

3. A method of constructing a borehole forming rotary rock bit, comprising the steps of:

providing a rock bit arm;

providing a bearing pin, said bearing pin having a bearing section with an annulr bearing surface and a mounting section with a bearing pin mounting surface;

providing a rotatable cutter having an annular bearing surface adapted to functionally interact with said annular bearing surface of said bearing section of said bearing pin;

providing an annular groove on said bearing pin;

providing an annular retainer element;

positioning said annular retainer element around said bearing pin projecting into said annular groove with said rotatable cutter being positioned over said bearing pin adjacent said annular retainer element thereby forming a first seam between said annular retainer element and said rotatable cutter;

directing a beam of energy into said first seam;

causing relative movement between said beam of energy and said first seam to fuse said annular retainer element to said rotatable cutter, said retainer element and groove cooperating to lock said cutter on said bearing pin;

providing an annular seal element;

positioning said annular seal element over said bearing pin in position to prevent materials in the borehole from contacting said annular bearing surface of said bearing pin and said annular bearing surface of said rotatable cutter;

placing said bearing on said rock bit arm thereby forming a second seam;

directing a beam of energy into said second seam; and causing relative movement between said beam of energy and said second sam to fuse said bearing pin to said rock bit arm.

* * * * *